US007275745B2

(12) United States Patent
Alleyne

(10) Patent No.: US 7,275,745 B2
(45) Date of Patent: Oct. 2, 2007

(54) WEALTH BOARD GAME

(76) Inventor: Derel Dacosta Alleyne, Upper Apartment, 6 Valley View Lane, Pembroke (BM) HM 02

( * ) Notice: Subject to any disclaimer, the term of this patent is extended or adjusted under 35 U.S.C. 154(b) by 64 days.

(21) Appl. No.: 11/162,014

(22) Filed: Aug. 25, 2005

(65) Prior Publication Data

US 2007/0045953 A1 Mar. 1, 2007

(51) Int. Cl.
*A63F 3/00* (2006.01)

(52) U.S. Cl. ..... 273/242; 273/256; 273/278

(58) Field of Classification Search ..... 273/242, 273/256, 278

See application file for complete search history.

(56) References Cited

U.S. PATENT DOCUMENTS 4,991,853 A 2/1991 Lott
5,071,135 A 12/1991 Campbell
5,388,836 A 2/1995 Foti
5,788,234 A 8/1998 Siofer
5,788,235 A 8/1998 Thomas
5,876,035 A * 3/1999 Medina, Jr. ..... 273/254
6,032,957 A 3/2000 Kiyosaki
6,488,283 B1 12/2002 Grundy

* cited by examiner

*Primary Examiner*—Vishu Mendiratta
(74) *Attorney, Agent, or Firm*—Louis Ventre, Jr.

(57) ABSTRACT

A board game and method of playing the board game wherein players move their game pieces in a path on the game board having landing spots in accordance with a combination of a numbers die and a words die. A spinner having a finger-activated spinning arrow pivotally attached at the center is used in conjunction with the words die. Play money in a plurality of denominations is awarded or taken away in accordance with the consequences determined by the dice, the spinner, and the instructions on the landing spot.

10 Claims, 4 Drawing Sheets

WEALTH BOARD GAME

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates to a board game of chance and a method of playing the game for entertainment, education on business concepts to amass wealth and enhancing decision-making skills.

DESCRIPTION OF PRIOR ART

There are various board games taught in the prior art that involve the creation of wealth and asset accumulation. These typically involve moving a player piece around the board in response to a roll of the dice.

However, the prior art board games possess inherent disadvantages when compared with the present invention in terms of creating an entertaining experience while simultaneously challenging a player with unforeseeable chance events and with a need to make decisions leading to a successful outcome. In general, the significant differences between the prior art and the present invention lie in the entertainment value, degree of unpredictability and randomness in movement, required decision-making strategies and the business-oriented theme to enhance its educational potential.

U.S. Pat. No. 6,488,283 to Grundy on Dec. 3, 2002 teaches a board game based on a futuristic space theme and requiring skill and memory. The playing surface used for the game is a game board having landing positions representing real and/or imaginary regions in outer space. Tortuous paths are provided between various planets and regions in space. Each player has a game piece, which represents a space ship or space shuttle. The player pieces are moved along the paths according to the throw of one die, two dice, a spinner, or a programmed random indicator, which simply indicate the number of spaces to be moved.

The '283 patent is typical of many board games known in the prior art. While this game involves movement around the game board, dice and random movement, the present invention is significantly different in format; the present invention does not use planetary systems and has a sinuous but simple path for transitioning the play. The present invention uses simple coin shaped landing spots similar in shape to the colored game status pieces.

The present invention is significantly different from the '283 patent in the degree of unpredictability in the movement of the player's piece. Players may move forward or backward or not at all upon the throw of a number die, depending on the result from a simultaneous throw of a words die, the judgments to be made by the player and on occasion, the random choice created by the spin of the circular wheel of success.

The present invention is significantly different from the '283 patent in the randomness in movement of the player's piece by creating more options in two dimensions. A player does not simply roll dice or use a random number generator and then move forward that number of spaces. Rather a numbers die and a words die enhance randomness of the potential for movement and determine the amount of play money to be potentially earned by the player in the move. Money is only earned if there is a forward movement of the players piece, so this factor must be weighed by the player in determining how to move the piece as permitted by the words die.

The present invention is significantly different from the '283 patent in the required decision-making strategies. Movement of the piece can enhance or adversely affect one's wealth and in some cases require the player to start all over with no funds. Decision making becomes fun in making choices to take advantage of the options offered by the number die, the words die, the spinner, the path alternatives directed on the potential landing spot, and the potential drawing cards available on the potential landing spot.

Finally, the present invention is significantly different from the '283 patent in theme. The present invention uses a business theme for the game and an embodiment of the invention factors in the tax advantages of capital investments over simply retaining cash value. In this embodiment, the business theme is enhanced by the potential for buying foreclosed properties at bargain prices, or simply purchasing properties and using the tax advantage of capital property over cash when one lands on a spot that requires a draw of a tax card.

While the '283 patent can be said to represent the vast majority of board games and the distinctions from the present invention apply in a similar manner to this kind of prior art, other prior art also deal with a similar theme of finances and the business world. This prior art, however, also suffers from significant disadvantages over the present invention in entertainment value, degree of unpredictability and randomness in movement, required decision-making strategies.

U.S. Pat. No. 6,032,957 to Kiyosaki on Mar. 7, 2000 discloses a board game for teaching financial skills to players. Using aspects of personal finance and investing and accounting techniques, significant wealth may be accumulated. Each player has a profession and must follow rules and accessories for teaching the science of personal finance, investing basic accounting and the accumulation of significant wealth. There are two stages of play involving two different tracks. By prudently investing as opportunities arise, a player may obtain passive income in addition to a salary. Once a player's passive income exceeds his/her expenses, the player moves to the Fast Track for further play. On the Fast Track, a player enjoys the greatly improved life of one who has accumulated significant wealth. However, provision is made for unexpected problems in various Fast Track spaces along which a player moves.

The present invention does not employ two tracks as used in the '957 patent, but rather grants special privileges on the same track when a player reaches the halfway point. Further the '957 second track is attained by the having income greater than expenses and the present invention grants special privileges only when a player attains a position on the board. The present invention does not grant income on the basis of investments, but rather is based on chance status in the roll of the numbers die. The present invention is significantly different in that it is more an entertaining game of chance than a sophisticated tool for understanding and employing the rules of basic accounting and the science of personal finance. The present invention is also fundamentally different in the enhanced randomness of game board action.

U.S. Pat. No. 5,826,878 to Kiyosaki on Oct. 27, 1998 discloses a game for teaching fundamental aspects of personal finance, investing and accounting in much the same way as the '957 patent described above. The differences between that '878 and the present invention are the same as noted above for the '957 patent.

U.S. Pat. No. 5,788,234 to Siofer on Aug. 4, 1998 teaches a business board game in which players attempt to win the game by transforming industries into cartels. Transformation of industries into cartels is by means of buying the majority of partnership stocks of all companies placed within specific industries. Controlling cartels enable players to sell essential products to their fellow players that own the partnership stocks in companies of other industries for a very high price to eventually cause bankruptcy. Players try to own as many partnership stocks as possible because they are the biggest source of income in the form of dividends. In addition, the game has a few companies that do not belong to any of the industries whose function is to provide services to the players for a fee.

While having a business theme, the present invention is different from the '234 patent in that it is not based on gaining control of industries to form industry cartels. The present invention does not involve purchasing partnership stocks, or businesses providing services to the players. The present invention is fundamentally different from the '234 patent in the entertainment value in the enhanced randomness of game board action.

U.S. Pat. No. 5,788,235 to Thomas on Aug. 4, 1998 teaches a business and economics related board game with the goal of purchasing businesses. Purchases can be made jointly between the players, or individually. During play, each player may jointly purchase various token businesses and further take out loans for purchasing the token businesses, thereby simulating a business environment. The '235 patent employs license cards, charity cards, auction cards, and token money bills.

The '235 patent is substantively very different from the present invention in that it concentrates on player interaction to a far greater extent for the purchase of businesses. In the present invention, businesses are not purchased from the other players, but from a global bank in consequence of random options granted in playing the game. The present invention does not include loans made for purchasing businesses. In addition, the '235 patent does not enhance the game playing experience with the unpredictability of randomness created by the use of two different kinds of dice enhanced by the spinning wheel and the instructions on the landing spots.

U.S. Pat. No. 5,388,836 to Foti on Feb. 14, 1995 discloses a board game of international finance, which simulates travel and financial exchanges between participants in two or more nations using different currencies. The game includes travel about two playing paths to be employed simultaneously along the periphery of the board and the simulated purchase by the players of various properties or cities in each nation. The owners of the properties or cities may collect taxes from other players who land on the owners' properties. Numerically uneven currency exchange rates enter into the play of the game and are randomly variable, according to the draw of cards during the game. The game is intended to provide a somewhat realistic simulation of current international financial dealings.

The present invention, unlike the '836 patent, does not involve different currencies but rather is based on a single currency. The present invention does not involve the theme of international travel and variable international currency exchange rates. Further, the present invention does not involve international finance. The present invention does not teach two playing paths, but rather uses a single playing path. An embodiment of the present invention involves property purchases, but does not involve simulated purchases of cities in a variety of nations. The present invention is fundamentally different in the entertainment value in the enhanced randomness of game board action.

U.S. Pat. No. 5,071,135 to Campbell on Dec. 10, 1991 discloses a board game simulating the risks and rewards of managing a financial portfolio in a typical market. The board has a peripheral playing path divided into several fields. Players advance using a throw of dice. The fields represent opportunities to buy or sell housing or stock, personal expenses to be paid, and salary to be received. The playing path is represented as one calendar year, and the fields are grouped into the four financial quarters of the year, wherein each side of the board represents a financial quarter. The game further includes returns tables having indexed monetary amounts. The dice randomly selects a monetary amount and this amount is added to the value of an investment, adjusting its value. The game involves players buying and selling stocks and housing, paying personal expenses, loaning other players money, rent and taxes, and receiving income. The object being to build the greatest financial worth.

Unlike the '135 patent, the present invention does not simulate the risks and rewards in a financial portfolio. The present invention is different from the '135 patent in that it does not involve the purchase and sale of housing, stock, and personal expenses. The present invention does not have a playing path representing a time scale and does not include returns tables having indexed monetary amounts. While the '135 patent employs dice, a words die is not employed. While income is in part determined by the random face on a die, the present invention does not act to adjust the value of an investment. The present invention does not involve the buying and selling of stocks and housing. There is no provision for players to loan other players money in the present invention. The method of winning in the present invention is not accumulating the greatest financial wealth, but rather is by circumnavigating the path on the game board twice while remaining solvent. Finally, the present invention is fundamentally different in the entertainment value in the enhanced randomness of game board action.

U.S. Pat. No. 4,991,853 to Lott on Feb. 12, 1991 teaches a financial board game wherein players, in turn, roll numbers dice to determine which company is in play. That player then has the option to buy stock in that company. When a player owns enough stock to be declared chairman of the board, he or she takes possession of the chairman of the board card for that company. Whenever another player owns more stock in a company than the current chairman of the board, that player takes possession of the chairman of the board card and is said to have taken over the company, thus, in the course of the game a company may change hands many times. Players encounter event cards that impact companies in play and personal cards that impact players holding chairman of the board cards. The player ending up with the most wealth at the end of the game is declared the winner.

In contrast to the '853 patent, the present invention does not involve the purchase of stock certificates or the ability of other players to rest control from other players by the purchase of stock. In the present invention, the winner is not determined on the most wealth, but rather navigating the board so that one has sufficient wealth to avoid going bankrupt while reaching the global bank for the second time.

The present invention uses two different kinds of dice, one of which being a words die. A words die is not used in the '853 patent. The present invention is fundamentally different in the entertainment value in the enhanced randomness of game board action.

It is, therefore, apparent that a need exists for a board game that creates an entertaining experience while simultaneously challenging a player with unforeseeable chance events, with a need to make decisions leading to a successful outcome and with a business-oriented theme to enhance its educational potential.

BRIEF SUMMARY OF THE INVENTION

The invention is a board game and a method of playing the board game for entertainment and educational purposes. The game has a game board with a path having landing spots including a starting position, an ending point, and a plurality of other landing spots at least some of which specify consequences for landing thereon. The game uses play money in a plurality of denominations. The game includes a numbers die to indicate one of six possible numbers when rolled and wherein each of said numbers determines the amount of play money that may be earned. The game includes a spinner having a finger-activated spinning arrow pivotally attached at the center and capable of indicating any of a plurality of pie-wedge segments that specify a player is to collect play money, or any of a lesser plurality of pie-wedge segments that specify a player is to miss a turn. The game includes a words die to indicate one of six possible consequences when rolled wherein at least one such consequence involves using the spinner. Finally, the game has game pieces each serving as a distinct marker for a player.

In the method of the invention, each of a plurality of players, rolls the number die to determine starting position and status indicated by the number of dots on the die. The status is used to determine the amount of money potentially earned on the next roll of the dice. The amount is only potentially earned because there must be a forward move before any money is actually earned by the player and such forward movement is conditional on any applicable consequences established by a roll of the words die. Then, each player rolls both dice and moves his piece in accordance with the options as presented by game and receives and gives up money according to his choices and moves. A player wins by circumnavigating the game board twice, ending at a global bank for the second time.

DETAILED DESCRIPTION OF THE INVENTION

The invention is a board game and method of playing the game. The board game captures a unique degree of unpredictability, randomness and strategy in an entertaining and educational combination of chance employing a numbers die, a words die, a spinner, play money to be earned or lost, and consequences noted on landing spots.

The numbers die is rolled to pick the number of potential spots along the path that a player may move his game piece. The rolled number also introduces randomness in the amount of play money that may be earned by a forward movement of the game piece. The words die brings into play other variables, at least one of which is the use of a spinner. Judgment and strategy is introduced by creating options to be exercised with instructions on the words die and consequences stated on some landing spots.

The game has any number of different embodiments that capture these features of interplay delivering a unique level of entertainment, a unique degree of unpredictability and randomness in the play, and requiring educational strategies employing judgment-influenced options to win the game by twice circumnavigating the path and being the first to remain financially solvent while landing at the end point.

The embodiments used as examples in this description and the figures explain the preferred and other embodiments that add additional features to the invention. These embodiments are examples of the invention and are not intended to limit the claims. Rather, the invention is not limited by the examples or embodiments described herein but captures all the embodiments employing the elements of the invention described in the claims and their equivalents.

Figure 1:
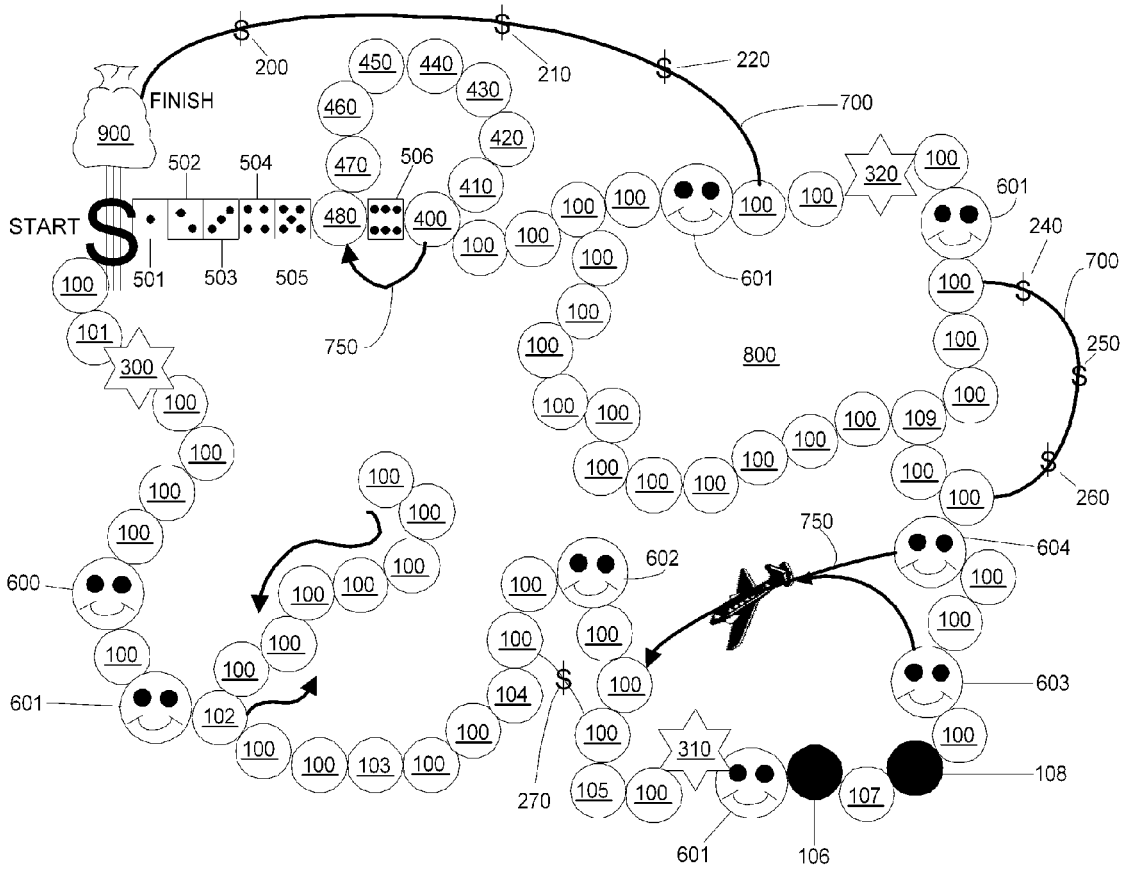
FIG. 1 is a top view of the preferred embodiment of the game board.

In the preferred embodiment, the game includes (1) a game board, shown in FIG. 1, with a variety of landing spots; (2) two dice, one having colored dots on each face and the other having words indicating different consequences on each face; (3) a finger-activated spinner, shown in FIG. 8, capable of landing on any of 7 pie-wedge segments to collect additional play money or 3 pie-wedge segments to miss a turn; (4) play money; and (5) six game pieces each serving as a distinct marker for a player.

An alternative embodiment further includes 36 game status pieces having 6 different colors and each stackable atop the game pieces. In this embodiment, the game pieces are stackable by having a bottom surface contoured to mate with the upper surface of the game pieces. Also included in this embodiment are twelve foreclosure sale title deeds; twelve real estate title deeds; twelve tax cards which specify compulsory donations or tax payments; ten business cards specifying various consequences; and six airplane-shaped game pieces to enable fly over rights.

The Game Board

In the preferred embodiment, a game board (800) is used, based on a theme of business success and failure through the gain and loss of play money wealth. The game board may be adorned with any appropriate background. This embodiment of the game board has a serpentine path of landing spots arranged for clockwise movement of the game pieces.

In the preferred embodiment, there is at least one spot, which connects to another distant spot by a solid line. Solid lines (700) provide short-cut paths with dollar sign landing spots after a player passes the global bank the first time, i.e., the halfway point. These solid lines are silver-colored in the preferred embodiment. In an alternate embodiment of the invention, a player earns an airplane-shaped game piece, shown in FIG. 4, after the player passes the halfway point. The airplane-shaped game piece helps the players to keep track of the ability to use any short-cut path.

The landing spots include coin-shaped spots (100) through (109), including black hole spots (106) and (108); dollar sign ($) spots; star-shaped status spots (300) through (320); dice shaped spots (501) through (506); and, smile-faced tax card spots (600) through (605). Some of the landing spots are labeled with directional information or consequences applicable when one's game piece lands on them.

The 100 series landing spots are (100) through (109) with the following consequences: Silver-lined images approximating coins from around the world (100) permit landing on them without penalty or direction. A "recession" spot (101) specifies that a player must surrender his play money and lose as many turns of play as there are players. A "major catastrophe" spot (102) specifies that a player surrender his cash and assets and take a dead end detour. A "take over bid" spot (103) specifies the taking of all the wealth of the player that is on the spot closest in position to the "take over bid" spot, whether in front of, or behind, said spot, and if two players are the same distance away, then both such players must deliver their wealth to the player on the "take over bid" spot. A "serial merger" spot (104) specifies payment to the global bank of $20 million in play money. A "competition" spot (105) specifies payments to the other players of $1 million in play money per player to increase competition. One "black hole" spot (106) specifies that a player is bankrupt and must start over from the beginning. Another "black hole" spot (108) specifies payment of $5 million in play money to the global bank for a lawsuit. An "inheritance" spot (107) grants the player a business asset. A "spending spree" spot (109) is red lined, requires payment of money and denies the player any money paid to him on that turn.

The 200 series landing spots are (200) through (260) with the following consequences: A "foreign investment and business ventures" spot (200) specifies a $1 million payment to the player. An "initial public offering" spot (210) specifies a $1 billion payment to the player. A "network and trade agreements" spot (220) specifies a $1 million payment to the player. A "downsizing spot" (240) specifies a $1 million payment to the player. An "outsourcing spot" (250) specifies a $2 million payment to the player. A "mergers" spot (260) specifies a $1 million payment to the player.

The 300 series landing spots are (300) through (320) with the following consequences: A "movie star" spot (300) elevates income status to that of a movie star. A "pro athlete" spot (310) elevates income status to that of a professional athlete. A "pop star" spot (320) elevates income status to that of a pop star.

The 400 series landing spots are (400) through (480) with the following consequences: A "business failure" spot (400) specifies that the player receive no payment on that turn. A "high debt ratio" spot (410) specifies that the player pay $1 million on that turn. A "government taxes and regulates" spot (420) specifies that the player miss a turn. A "poor planning" spot (430) specifies that the player miss a turn. A "no business skills" spot (440) specifies that the player miss a turn. A "no innovation" spot (450) specifies that the player miss a turn. A "no cash for growth" spot (460) specifies that the player surrender all cash. A "poor management" spot (470) specifies that the player receive no payment on that turn. A "cash flow problems" spot (480) specifies that a player lose all property.

The 500 series landing spots are (501) through (506). These are the starting spots for the game.

The 600 series landing spots are (600) through (604) with the following consequences: A "top talk show host" spot (600) provides $500 million play money income. A "tax card" spot (601) directs the choosing of a tax card. A "lotto jackpot" spot (602) provides $50 million play money income. A "huge contract" spot (603) provides $50 million play money income and a private jet trip along an arrow (750) bypassing the bankruptcy spot (106). An "inherit a property" spot (604) provides a player with a draw of a real estate title deed to a property and a private jet trip bypassing the bankruptcy black hole spot (106).

The Dice

The invention uses two different kinds of dice, a numbers die and a words die. The preferred embodiment uses a numbers die of the usual variety in the sense of employing dots to represent numbers 1 to 6 on each face.

In an alternative embodiment, unlike the usual variety of numbers dice, the dots on the numbers die have a unique coloration for each face. The colored dots help keep track of the status of the players and give the game a brighter look. The dots are colored as follows, 6—Purple; 5—Red; 4—Gold; 3—Green; 2—Brown; and 1—Blue. In this embodiment, each player is given a game status piece matching the color of the initial number he rolls with the numbers die.

In the preferred embodiment, the words die specifies six different options or consequences. The options or consequences are: (1) SUPER OPPORTUNITY, plus a six on the numbers die allows the player to use the spinner and pull a business card (all other numbers plus super opportunity spins the wheel but do not pull a business card); (2) SECOND CHANCE, which provides an option to move or not to move forward and grants another turn; (3) OBSTACLE, which prevents movement of the game piece on that turn; (4) FAIL, which requires a backward move by the amount indicated on the numbers die; (5) BREAK EVEN, which requires a forward move, but without collecting any play money on that turn; and (6) MODEST REWARD, which provides an option of moving or not moving. Thus, with the words die, it is possible to take advantage of circumstances that might other wise prove too costly.

To begin the game, each player first rolls the number die to determine starting position and status indicated by the number. In the alternate embodiment, the status is also indicated by the color of the dots on the numbers die. The player with the highest number starts first in the best location (506) and highest status. The player with the lowest number starts last in the worst location (501), and has the lowest status.

The status is used to determine the amount of money potentially earned on the next roll of the dice. Status is only earning potential because there must be a forward move before any money is actually earned by the player and such forward motion is conditional on the roll of the words die.

The available status positions for each number and color on the numbers die are: 6—Purple status earning $1 billion per forward move; 5—Red status earning $1 million per forward move; 4—Gold status earning $100,000 per forward move; 3—Green status earning $100 per forward move; 2—Brown status earning $10 per forward move; and 1—Blue status earning $1 per forward move. Thus, the status correlates with the number and the color of the dots. In the event of ties the player who threw first, plays first. In the alternative embodiment, a player's status may be kept track of by stacking the matching color game status piece atop the original player game piece.

The Spinner

The invention has a spinner of the type commonly found in board games being essentially circular with a finger-activated spinning arrow pivotally attached at the center.

Figure 8:
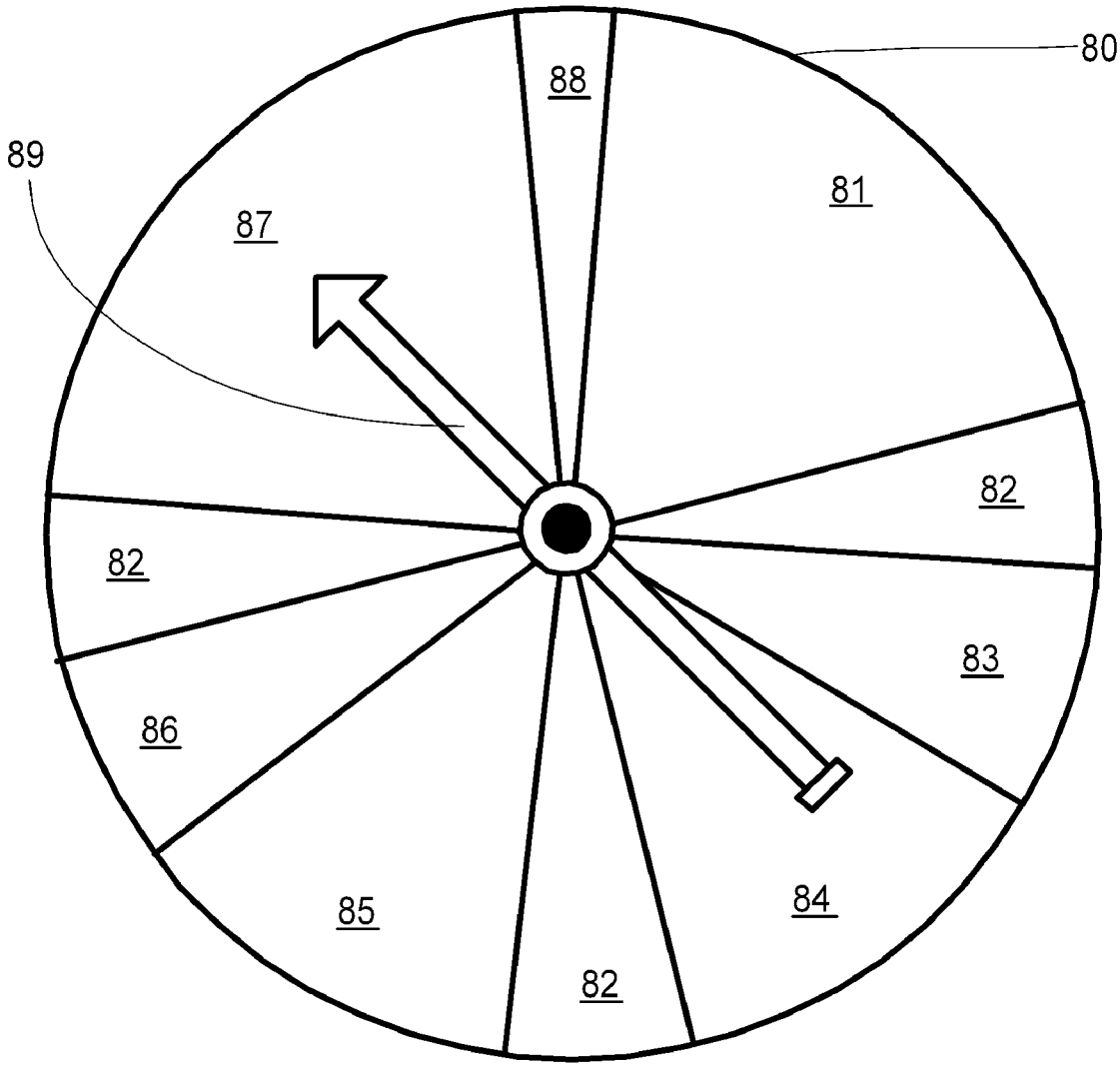
FIG. 8 is a top view of the preferred embodiment of a spinner.

In the preferred embodiment, the spinner is designated the "wheel of success" and is shown in FIG. 8. The arrow (89) is capable of landing on any of 7 pie-wedge segments (81) and (83) through (88) specifying the payment of play money to the player spinning the arrow, or on 3 pie-wedge segments (82) requiring that player to miss a turn. The available payments are: Savings Interest of $100 (81); Stocks and Bonds of $10,000 (83); Inheritance of $100,000 (84); Business Venture of $1 billion (85); Real Estate Investment of $1 million (86); Income of $100,000 (87); and Lotto winnings of $50 million.

Play Money

The invention uses play money of a variety of denominations suitable to make the payments required in playing the game.

In the preferred embodiment, there are 8 denominations of paper play money and there are 100 pieces of each denomination. In an alternative embodiment, the play money is also color coded somewhat consistently with the status coloration. Specifically, the denominations are (1) $1 billion colored purple; (2) $100 million colored red; $10 million colored red; $1 million colored red; (3) $100,000 colored gold; (4) $100 colored green; (5) $10 colored brown; and (6) $1 colored blue. As noted, the red color is also used for the $10 million and $100 million denominations even though these denominations are not earned on a roll of the dice yielding that color.

Foreclosure Sale Title Deeds

An alternate embodiment of the invention includes foreclosure sale title deeds, which are simply cards that describe a property that may be purchased by auction bidding from among the players. Every player is required to auction a property when that player passes the spending spree spot (109). A player that does not have a property to auction is declared bankrupt and must start over.

Figure 5:
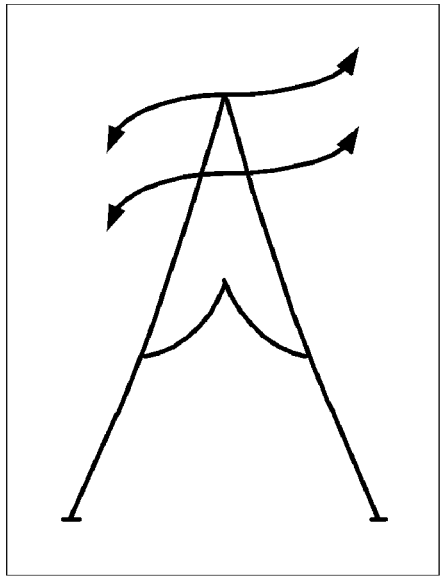
FIG. 5 is a top view of a card used for business cards.

In this alternate embodiment of the invention, there are 12 foreclosure sale title deeds, having a backing with the distinctive "A" shown in FIG. 5. The other side of a foreclosure sale title deed describes the property available for bidding, its value and lists the starting bid for that property.

In the method of the preferred embodiment, when a player reaches the global bank, that player must pay taxes of 50% on cash incomes over $1 Million and 50% on lotto jackpot income. If a player has insufficient play money to pay taxes, he is bankrupt and must start over.

In an alternate embodiment having deeds for properties, the taxes include a 10% on property value owned by the player. Tax payments must be made prior to bidding on any foreclosure property. Bids must start at the indicated starting bid and increase in increments of $10 Million. Once there is a bid for the property and no further bids are made, the player who caused the auction to begin gives a final opportunity to bid by saying, "Going once, going twice, sold!" If no one bids in response to the final opportunity, the property is exchanged for the final play money bid.

In the method of this alternate embodiment, the player seeks to obtain property through foreclosures so that the player acquires wealth or assets at a discounted rate. A player minimizes loss of wealth from taxation by the accumulation of properties, which are taxed at a lower rate. Usually, the bid price will be a fraction of the real value of the property. In the event a player needs cash or is calculating one's net worth, then this will be determined by adding cash, property values and any other income, such as a tax refund. A player must implement his strategy with the understanding that a player will be forced to start over if the player goes bankrupt.

Real Estate Title Deeds

An alternate embodiment includes real estate title deeds, which are simply cards that describe a property that may be purchased from the global bank by any of the players when it is their turn to move or when otherwise given the opportunity to purchase property in the conduct of the game.

In this embodiment of the invention, there are 12 real estate title deeds.

Tax Cards

An alternate embodiment includes tax cards, which specify tax payments or tax refunds and which are drawn when a player lands on the tax card spot (601).

Figure 6:
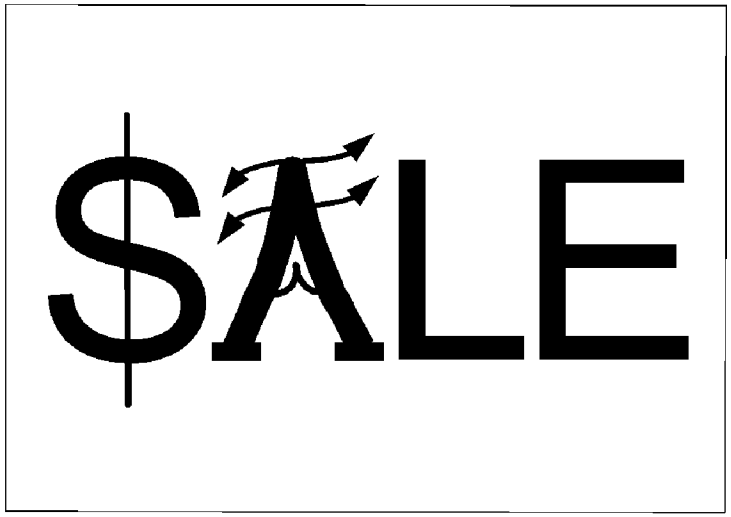
FIG. 6 is a top view of a card used for foreclosure sale title deeds and real estate title deeds.
Figure 7:
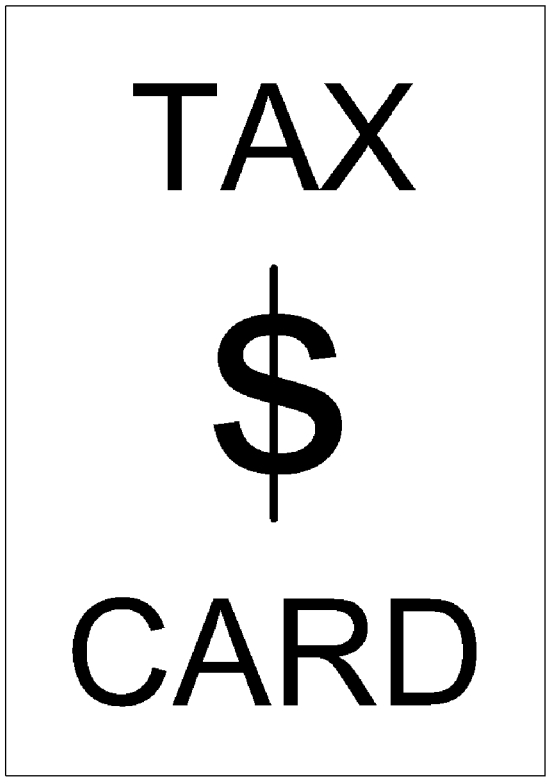
FIG. 7 is a top view of a card used for tax notices.

In this embodiment, there are 12 tax cards. The back of the tax card in this embodiment is shown in FIG. 6. In an alternate embodiment of the method of the invention, players would pursue a strategy of trying to get tax cards specifying a refund as they could significantly affect assets held when that player is required to pay taxes.

Business Cards

An alternate embodiment includes business cards, which specify required consequences for failed businesses and at least one card specifying a payment to the player of significant income.

In this embodiment, there are 10 business cards. These businesses include utilities, TV network, mobile phone services, supermarket, retail mall, sole proprietor, banking, airline, real estate, manufacturing, and inventor.

In this embodiment, nine of these business cards describe failed businesses, why it failed and the payment of debt required by the failure. The significance of having 9 out of 10 business cards indicating a failed business is to reflect the fact that in the real world 9 out of every 10 businesses fail within the first 5 years. The remaining business card is designated a "pinnacle of success," giving the player $500 million in play money.

Game Pieces

The invention includes game pieces each serving as a distinct marker for a player.

In the preferred embodiment, the game pieces are in the general shape of luxury cars.

Game Status Pieces

Figure 2:
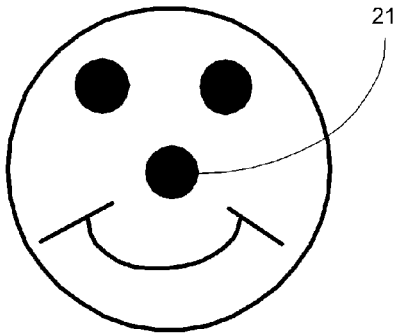
FIG. 2 is a top view of a game status piece.
Figure 3:
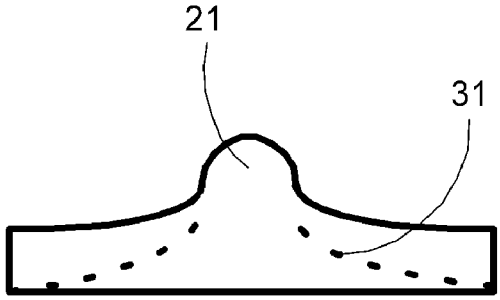
FIG. 3 is a side view of a game status piece.

In an alternative embodiment, there are game status pieces, shown in FIGS. 2 and 3, used to keep track of the status of the players, that is; income status as determined by the numbers die. There are 36 game status pieces in the shape of a smile face having 6 different colorations to indicate status. In this embodiment, the colorations are consistent with any colorations on the numbers die, that is, Purple status earning $1 billion per forward move; Red status earning $1 million per forward move; Gold status earning $100,000 per forward move; Green status earning $100 per forward move; Brown status earning $10 per forward move; and Blue status earning $1 per forward move. The game status pieces are stackable atop the game pieces.

In this alternate embodiment, stackability is provided by an elevated nub on the top of the game piece and a similar nub (21) on the game status piece. This nub also serves to hold the airplane-shaped game piece. The game status pieces also have a corresponding matching contour on their underside to aid in stackability with other game status pieces.

Airplane-Shaped Game Piece

An alternate embodiment of the invention includes an airplane-shaped game piece for every game piece.

Figure 4:
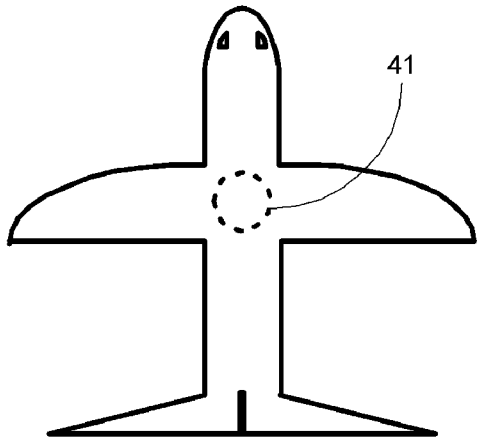
FIG. 4 is a top view of an airplane-shaped game piece.

In this embodiment, there are 6 distinct game pieces and, so, there are 6 airplane-shaped game pieces, which are stackable atop the game pieces and the game status pieces. FIG. 4 shows the top view of this airplane-shaped game piece. It has a shaped body segment (41) in the bottom of the airplane-shaped game piece to receive the nub (21) on the top of each game status piece and each game piece.

In the method of the invention for this alternate embodiment, the airplane-shaped game piece is awarded to a player after that player passes the global bank once, in which the player is said to "capture the bank." Each player who captures the bank gets his wings, signified by the airplane shaped game piece added to his game piece. The airplane shaped game piece requires the player to fly over and take a shortcut on the path connected by solid silver colored lines (700).

In the method of the invention, players roll the numbers die to determine their starting position and status. Then, each player in turn rolls the two dice together wherein the numbers die indicates the potential destination landing spot along the path and the words die indicates the direction of travel or other consequence. Then, play proceeds as the players take the appropriate action in accordance with the consequence indicated on the words die and on the destination landing spot and exercising judgment necessary to avoid bankruptcy and insolvency. This process is repeated until such time as one of the players lands on the global bank (900) a second time. If the game is abandoned before completion, the player with the most cash plus assets minus all debts wins.

Movement of the game pieces and the accumulation or loss of play money wealth is dictated by chance and choices made in employing random choice generators and selecting judgment-influenced options. In an alternate embodiment, a player can minimize the loss of wealth from taxation by the accumulation of properties, which are taxed at a lower rate. A player must start over if he goes bankrupt.

In the preferred embodiment of the method of the invention, up to six players gain and lose play money in playing the game. The successful players will strategize to avoid the spots marked as obstacles and black holes, which specify penalties that force players to give up play money. Added to the strategy calculation in an alternate embodiment, the taxation rules provide incentives to acquire properties from the global bank (900), which are taxed at a lower rate. When a movement option is available based on the words die, then the player must consider and then decide on whether or not the amount earned by a forward movement option should be accepted in light of any penalty to be received at the landing spot.

While there has been described herein what are considered to be the preferred exemplary embodiment of the present invention and alternates, other modifications of the present invention shall be apparent to those skilled in the art from the teachings herein, and it is therefore, desired to be secured in the appended claim all such modifications as fall within the true spirit and scope of the invention. Accordingly, what is desired to be secured by Letters Patent of the United States is the invention as defined and differentiated in the claims that follow.

What is claimed is:

1. A board game for a plurality of players comprising, a game board with a path having landing spots including a starting position, an ending point, and a plurality of other landing spots at least some of which specify consequences for landing thereon;

play money in a plurality of denominations;

a numbers die to indicate one of six possible numbers when rolled and wherein each of said numbers determines a potential move on the landing spots and the amount of play money that may be earned;

a spinner having a finger-activated spinning arrow pivotally attached at the center and capable of indicating any of a plurality of pie-wedge segments that specify collection of play money, or any of a lesser plurality of pie-wedge segments that specify missing a turn;

a words die to indicate one of six possible consequences when rolled wherein at least one such consequence involves using the spinner;

game pieces each serving as a distinct marker for a-player;

foreclosure sale title deeds;

real estate title deeds;

tax cards, which specify compulsory donations, refunds, or tax payments;

business cards, which specify various consequences;

game status pieces in sets of distinct colors to joinably mate with the top of the game pieces; and, an airplane-shaped game piece for every set of game status pieces to joinably mate with the top of the game status pieces.

2. The board game of claim 1 wherein the spinner comprises 7 pie-wedge segments specifying that a player collect additional play money and 3 pie-wedge segments specifying that a player to miss a turn.

3. The board game of claim 1 wherein there are 8 denominations of paper play money and there are 100 pieces of each denomination, such denominations being (1) $1 billion; (2) $100 million; (3) $10 million; (4) $1 million; (5) $100,000; (6) $100; (7) $10; and (8) $1.

4. The play money of claim 3 wherein each of the 8 denominations has a coloration (1) $1 billion colored purple; (2) $100 million colored red; (3) $10 million colored red; (4) $1 million colored red; (5) $100,000 colored gold; (6) $100 colored green; (7) $10 colored brown; and (8) $1 colored blue.

5. The board game of claim 1 wherein landing spots are dice-shaped spots for placing the game piece at the start of the game;

coin-shaped spots some of which have consequences, some of which have no consequence to landing on them, and at least one of which connects to another distant spot by a solid line;

dollar sign spots for use on the solid lines;

star-shaped status spots, which confer professional status and which grant the player play money;

smile-faced tax card spots, which require taking a tax card; and, a global bank spot signifying the halfway spot and ending spot of the game.

6. The board game of claim 1 wherein there are 36 game status pieces having 6 different colors and each of said game status pieces are stackable atop the game pieces.

7. The board game of claim 1 wherein there are 12 foreclosure sale title deeds, 12 real estate title deeds, 12 tax cards, and 10 business cards.

8. A method for each player to play a board game comprising the steps of:

providing a path having landing spots comprising dice-shaped spots for placing the game piece at the start of the game; coin-shaped spots some of which have consequences, some of which have no consequence to landing on them, and at least one of which connects to another distant spot by a solid line; dollar sign spots for use on the solid lines; star-shaped status spots, which confer professional status and which grant the player play money; smile-faced tax card spots, which require taking a tax card; and a global bank spot signifying the halfway spot and ending spot of the game;

providing a numbers die to indicate one of six possible numbers when rolled and wherein each of said numbers determines a potential move on the landing spots and the amount of play money that may be earned;

providing a words die to indicate one of six possible consequences when rolled wherein at least one such consequence involves using the spinner;

providing game pieces each serving as a distinct marker for a player;

providing foreclosure sale title deeds;

providing real estate title deeds;

providing tax cards, which specify compulsory donations, refunds, or tax payments;

providing business cards, which specify various consequences, game status pieces in sets of distinct colors to joinably mate with the top of the game pieces;

providing an airplane-shaped game piece for every set of game status pieces to joinably mate with the top of the game status pieces;

rolling the numbers die to determine the player's starting position and status;

rolling the two dice together wherein the numbers die indicates the potential destination landing spot along the path and the words die indicates the direction of travel or other consequence;

stacking a game status piece on a game piece to indicate status;

taking the appropriate action in accordance with the consequence indicated on the words die and on the destination landing spot and exercising judgment necessary to avoid bankruptcy;

using the airplane-shaped game piece after a player passes the global bank once to signify the ability of a player to use solid lines marked with dollar signs as a short cut path;

deciding on the purchase and sale of real estate when given the opportunity to do so in playing the game; and, repeating the above steps beginning with the step of rolling the numbers die to the step of deciding on the purchase and sale of real estate until a player lands on the global bank twice.

9. The method of claim 8 wherein each number rolled when rolling the two dice together corresponds to a quantity of dots having coloration that corresponds to an amount of play money to be earned on forward movement of the game piece as follows, 6 purple dots earns $1 billion per forward move; 5 red dots earns $1 million per forward move; 4 gold dots earns $100,000 per forward move; 3 green dots earns $100 per forward move; 2 brown dots earns $10 per forward move; and 1 blue dot earns $1 per forward move.

10. The method of claim 8 wherein when taking the appropriate action in accordance with the consequence_indicated on the words die, such consequences are: SUPER OPPORTUNITY, which grants an opportunity to use the spinner and if the number six is rolled on the numbers die, to also draw a business card; SECOND CHANCE, which provides an option to move or not to move forward and grants another turn; OBSTACLE, which prevents movement of the game piece on that turn; FAIL, which requires a backward move by the amount indicated on the numbers die; BREAK EVEN, which requires a forward move, but without collecting any play money on that turn; and, MODEST REWARD, which provides an option of moving or not moving.

* * * * *